US011612196B2

(12) United States Patent
Bretz et al.

(10) Patent No.: US 11,612,196 B2
(45) Date of Patent: Mar. 28, 2023

(54) BIB WITH BLADDER POCKET AND LIQUID BLADDER

(71) Applicant: Westlife Express, LLC, Gardena, CA (US)

(72) Inventors: Michael Bretz, Redondo Beach, CA (US); Michael Akira West, Manhattan Beach, CA (US)

(73) Assignee: WESTLIFE EXPRESS, LLC, Gardena, CA (US)

( * ) Notice: Subject to any disclaimer, the term of this patent is extended or adjusted under 35 U.S.C. 154(b) by 382 days.

(21) Appl. No.: 16/460,751

(22) Filed: Jul. 2, 2019

(65) Prior Publication Data

US 2021/0000196 A1 Jan. 7, 2021

(51) Int. Cl.
*A41D 13/02* (2006.01)
*A41D 15/00* (2006.01)

(52) U.S. Cl.
CPC ..... *A41D 13/02* (2013.01); *A41D 15/00* (2013.01); *A41D 2300/322* (2013.01); *A41D 2400/46* (2013.01)

(58) Field of Classification Search
CPC ..... A41D 13/02; A41D 15/00; A41D 2400/46
See application file for complete search history.

(56) References Cited

U.S. PATENT DOCUMENTS 1,356,364 A * 10/1920 Horn ..... A41D 13/02 2/79
2,129,486 A * 9/1938 Berman ..... A41D 13/046 2/51
4,090,650 A * 5/1978 Gotta ..... A45F 3/20 215/11.1
4,176,772 A * 12/1979 Danon ..... A45F 3/20 224/148.5
5,431,308 A * 7/1995 Tchen ..... A45F 3/16 222/175
5,571,260 A * 11/1996 Krug ..... A45F 3/16 222/175
5,864,880 A 2/1999 Adam
8,231,421 B1 * 7/2012 Hubbard ..... A41D 13/0125 441/92

(Continued)

OTHER PUBLICATIONS

Copenheaver, Blaine R., Notification of Transmittal of the International Search Report and the Written Opinion of the International Search Authority, or the Declaration, Nov. 30, 2018, 7 pages, PCT/US2018/053194, Alexandria, VA.

*Primary Examiner* — Sally Haden
(74) *Attorney, Agent, or Firm* — Stetina Brunda Garred and Brucker

(57) ABSTRACT

A bib includes a pant portion, a torso portion, a bladder pocket and a liquid bladder. The pants portion includes a waist section and a pair of leg sections. The torso portion extends from the waist section. The torso portion includes a front and back panels disposed respectively adjacent the abdomen and lower back when the bib is worn by the user. The torso portion includes an outer surface facing away from the user torso and an inner surface facing towards the user torso. The bladder pocket is between the inner and outer surfaces extending from the front panel around the back panel and to the front panel. The liquid bladder is disposed within the bladder pocket and extends from the front panel around the back panel and to the front panel.

16 Claims, 7 Drawing Sheets

(56) References Cited

U.S. PATENT DOCUMENTS

| | | | | |
|---|---|---|---|---|
| 9,095,178 | B1 * | 8/2015 | Mankaruse | A41D 13/012 |
| 10,617,157 | B2 * | 4/2020 | West | A41D 3/02 |
| 2002/0124294 | A1 * | 9/2002 | McKenzie | A41D 13/0002 2/69 |
| 2005/0022285 | A1 | 3/2005 | Berns et al. | |
| 2008/0179356 | A1 * | 7/2008 | Edy | A45F 3/20 224/148.2 |
| 2011/0041234 | A1 | 2/2011 | Blackford | |
| 2011/0197332 | A1 * | 8/2011 | Yu | A41D 3/00 2/85 |
| 2016/0135573 | A1 * | 5/2016 | Smith | A45F 3/20 222/175 |
| 2017/0013891 | A1 * | 1/2017 | Olvera | A41D 13/02 |
| 2019/0357603 | A1 * | 11/2019 | Price | B63C 9/1055 |
| 2021/0000196 | A1 * | 1/2021 | Bretz | A41D 13/0012 |

* cited by examiner

BIB WITH BLADDER POCKET AND LIQUID BLADDER

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a fluid hydration arrangement. More particularly, the present disclosure relates to a bib with a liquid bladder.

2. Related Art

Proper hydration is essential to the safe practice of a wide variety of recreational, professional and emergency outdoor activities. It is oftentimes desirable to transport a personal water supply while engaged in outdoor activities. In the context of winter sports activities, a thermos or water bottle can be carried in a person's jacket or backpack. Hydration packs in the form of a dedicated backpack having a liquid bladder are also commonly used. Winter sports activities, such as snowboarding, skiing, snowshoeing, or snowmobiling, may typically require brisk movements involving bending and twisting of the torso and swinging of the hips. The placement of a thermos or water bottle in a jacket pocket or the wearing of a backpack holding a thermos or water bottle, or the wearing of a hydration pack during such physical movements may all result in unwanted forces being exerted upon the person and their jacket. This is because liquids, such as water, have a relatively high mass density. This results in a shifting of the person's jacket and/or backpack/hydration pack as the mass of the carried liquid will tend to rotate or shift positions about the person's torso. Such unwanted rotation or shifting can throw a person off-balance, or at the least, be cumbersome and therefore annoying.

Moreover, the use of a thermos or water bottle is undesirable as they may easily be misplaced, dropped or damaged, and it can also be inconvenient for a person to access the thermos or water bottle while engaged in a physical activity. While use of a hydration pack with tubing having a nozzle or bite valve positioned by the person's neck or upper chest avoids these issues, as the person wears the hydration pack during physical activity. The shifting of the hydration pack during physical movements may be mitigated somewhat by tightly securing the hydration pack. However, a tightly secured hydration pack, in addition to winter clothing, is constricting, adds to the overall bulk of the items worn by the person, and impedes free movements of a person's upper torso.

In view of the foregoing, there is a need in the art for an improved method of transporting liquids in the context of winter sports activities.

BRIEF SUMMARY

In accordance with one embodiment, there is provided a bib for use by a user worn about a user waist and user torso with an abdomen and a lower back. The bib includes a pants portion that includes a waist section positionable about the user waist when the bib is worn by the user and a pair of leg sections extending from the waist section. The bib further includes a torso portion that is attached to the pants portion and extends from the waist section away from the pair of leg sections. The torso portion is positionable about the user torso when the bib is worn by the user. The torso portion includes a front panel disposed adjacent the abdomen when the bib is worn by the user. The torso portion includes a back panel disposed adjacent the lower back when the bib is worn by the user. The torso portion includes an outer surface facing away from the user torso when the bib is worn by the user. The torso portion includes an inner surface facing towards the user torso when the bib is worn by the user. The bib further includes a bladder pocket disposed between the inner and outer surfaces extending from the front panel around the back panel and to the front panel. The bib further includes an elongate liquid bladder that is sized and configured to be inflated with a liquid. The liquid bladder is disposed within the bladder pocket and extends from the front panel around the back panel and to the front panel.

The present invention advantageously recognizes that the liquid bladder may be integrated into the bib and specifically positioned about the lower back of the user from each side of the abdomen of the user when the bib is worn by the user. This allows for the user to carry a personal water or liquid supply without the typical drawbacks of using a thermos or water bottle in a pocket or backpack and/or having to wear a backpack or hydration pack on one's upper and mid back. The shifting of mass commonly associated with traditional water or liquid transport configurations (such as backpack type arrangements) is mitigated by having the liquid bladder wrapped around the lower back region of the user in a horizontal configuration. This is because such positioning is contemplated to be much closer to the center of gravity of the user. Also, the wrapped-around, horizontal configuration allows a liquid bladder to be snuggly fit about the user adjacent the waist.

According to various embodiments, the pants portion and the torso portion are not removeably connected. In another embodiment, the pants portion and the torso portion are removeably connected. The bib may include a pants portion fastening element disposed between the pants portion and the torso portion for removeably connecting the pants portion and the torso portion. The pants portion fastening element may be a zipper. In an embodiment, the torso portion extends beyond the abdomen and the lower back from the user waist when the bib is worn by the user. The bib may further include shoulder straps extending from the front panel to the back panel. The torso portion may be a vest. The outer surface of the back panel may include an outer access opening that extends to the bladder pocket. The bib may further include an access fastening element disposed about the outer access opening for opening and closing the outer access opening. The inner surface of the back panel may include an inner access opening that extends to the bladder pocket. The bib may further include an access fastening element disposed about the inner access opening for opening and closing the inner access opening. The liquid bladder may include a bladder body section disposed between opposing bladder ends. The bib may include a bladder fastener attached to the bladder ends for removably joining the bladder ends. This particularly allows for a snug fit about the user. The bladder ends may be elastically connected to each other via the bladder fastener to allow the bladder ends to move relative to each other while being connected by the bladder fastener. The bib may further include a pair of bladder extensions each disposed between a respective one of the bladder ends and the bladder fastener, and the bladder extensions are formed of an elastomeric material. This allows for longitudinal stretching to provide adaptable tension.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 1:
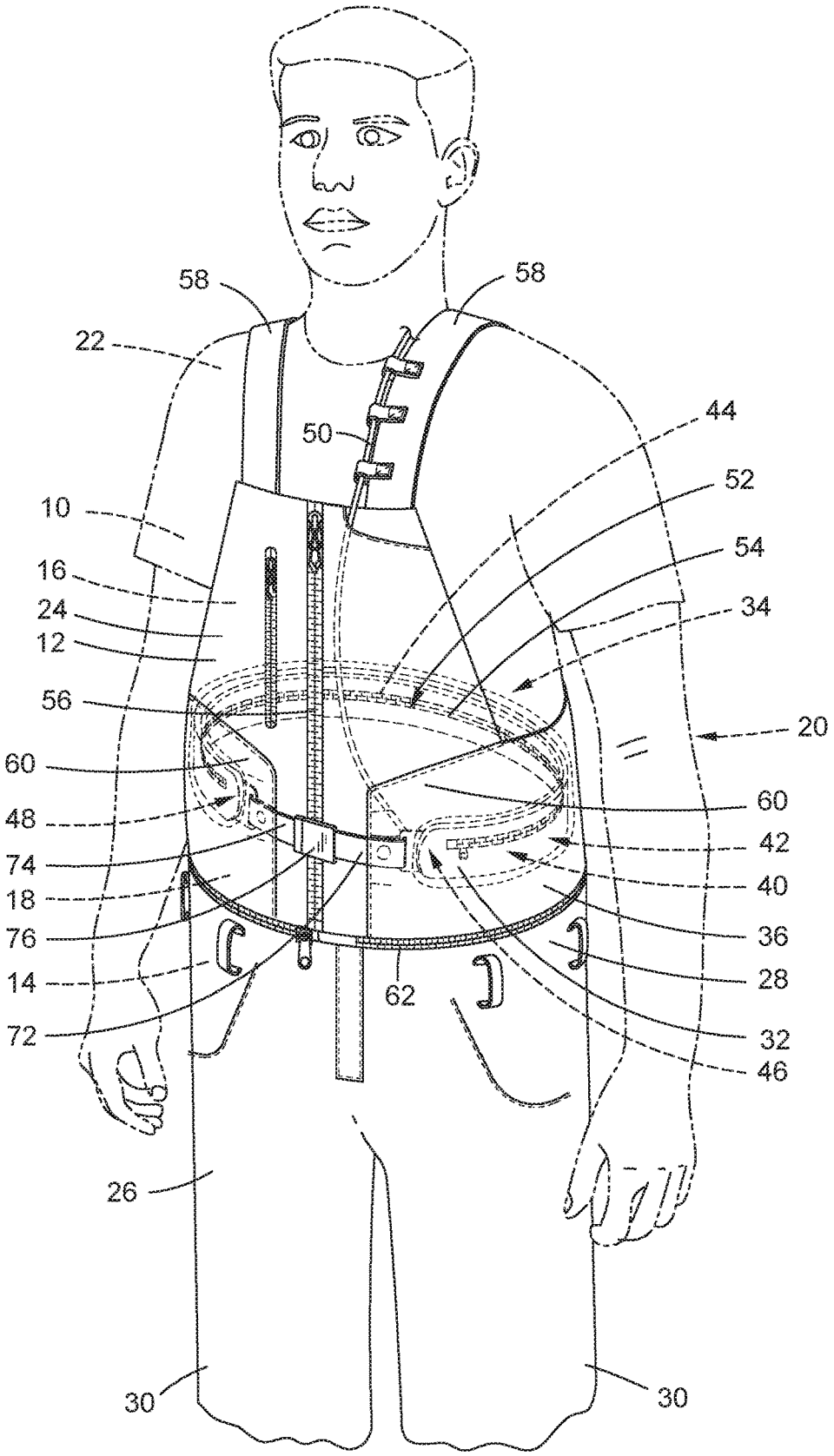
FIG. 1 is a perspective view of a user (in dashed lining) wearing a bib according to an embodiment of the invention.
Figure 2:
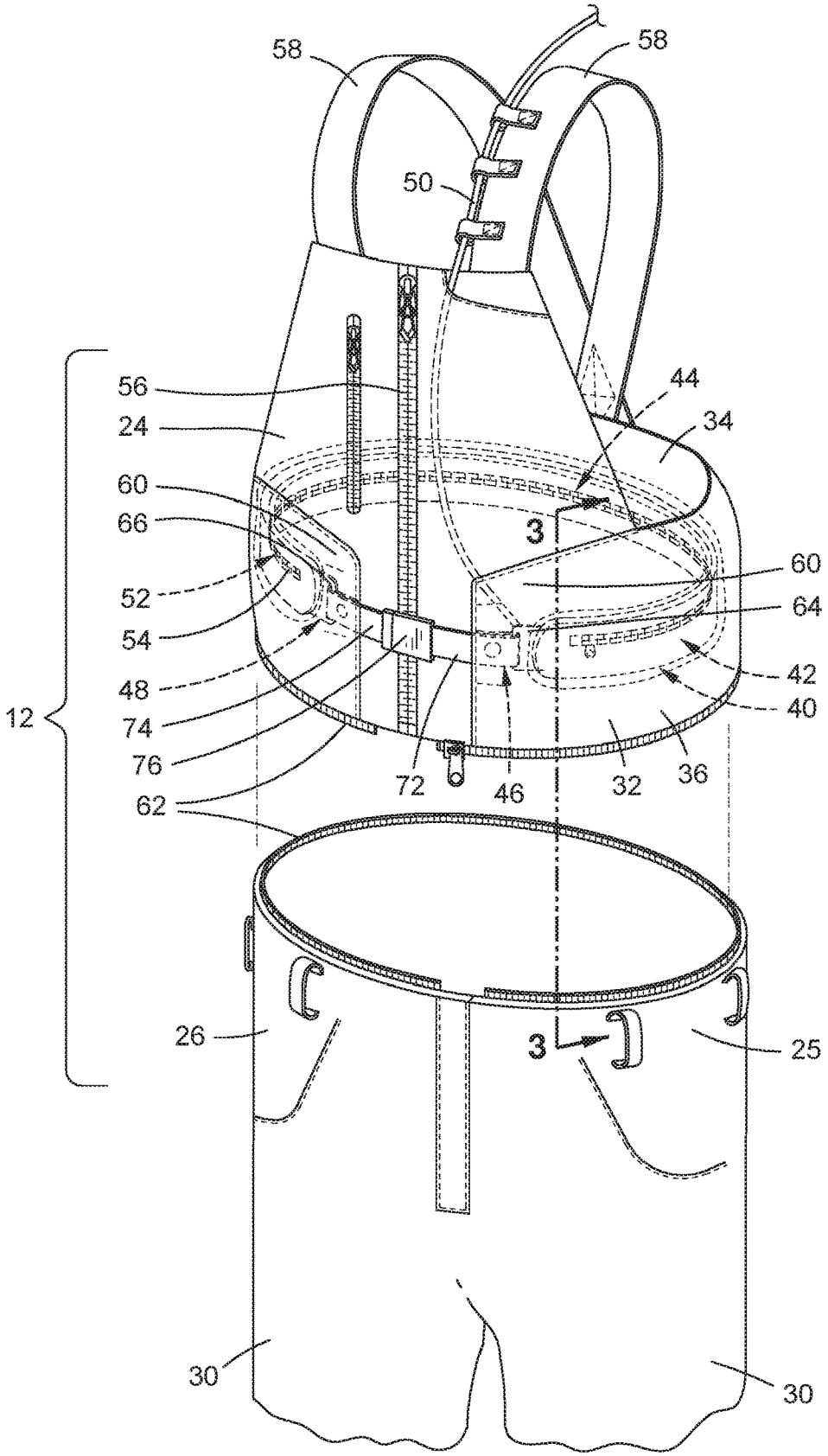
FIG. 2 is a perspective view of the bib with a torso portion exploded from a pants portion.
Figure 3:
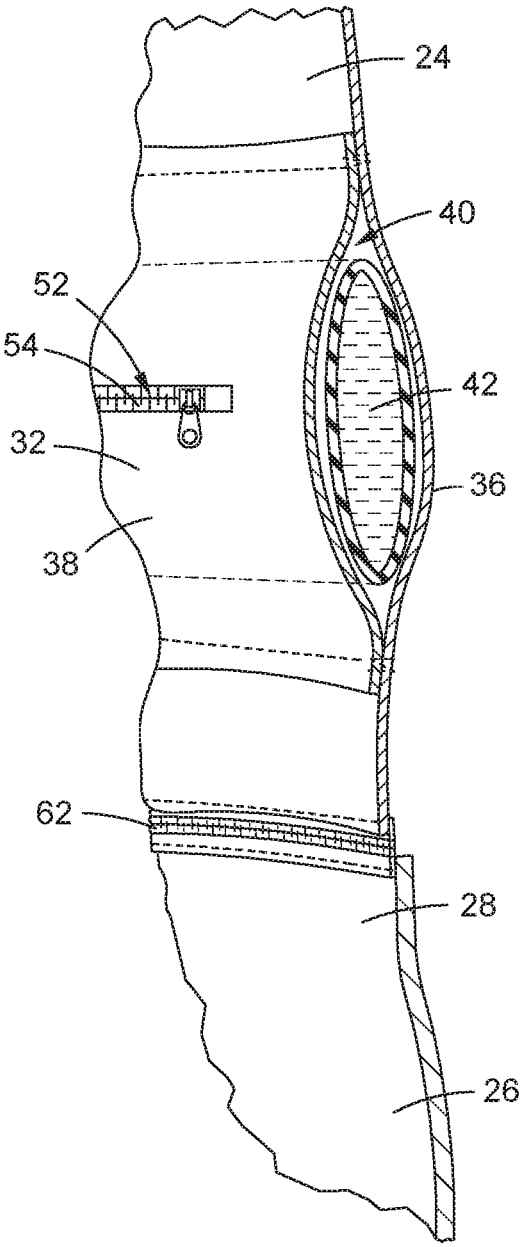
FIG. 3 is an enlarged perspective view of a portion of the torso portion and the pants portion where the two are removeably attached with a zipper as viewed along axis 3-3 of FIG. 2.
Figure 5:
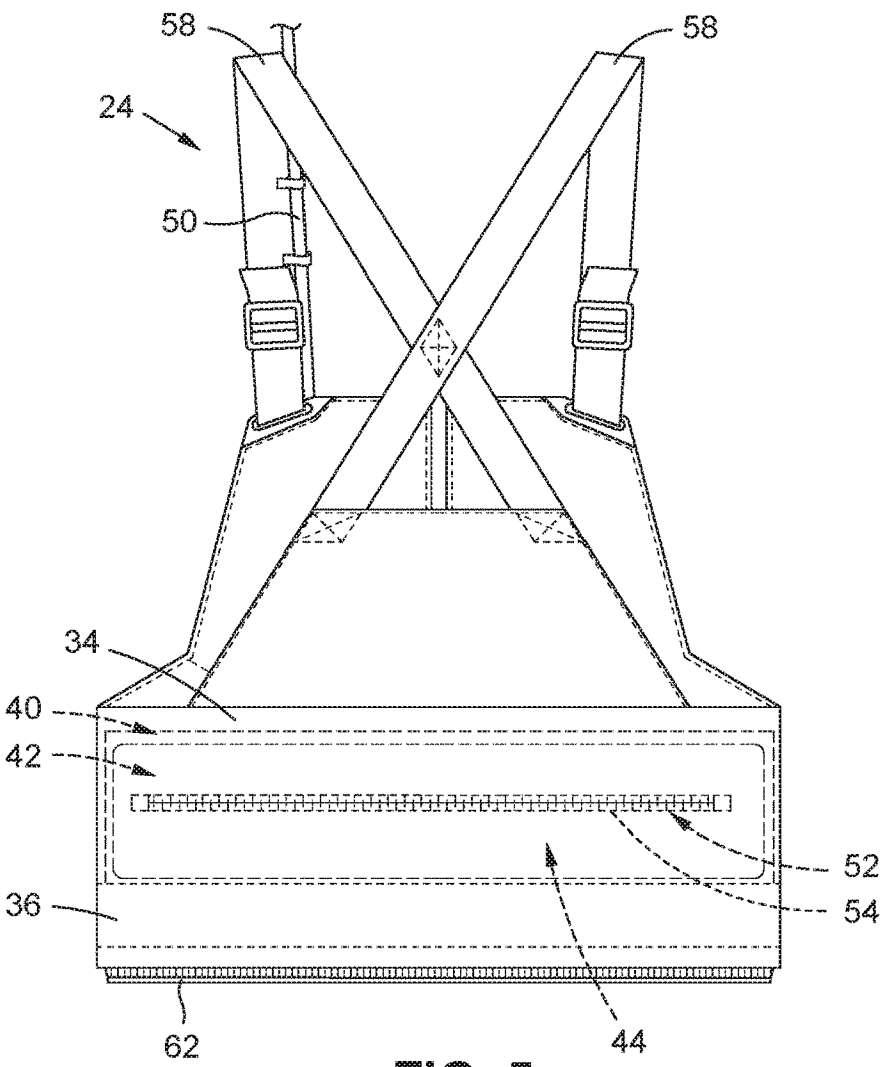
FIG. 5 is a back view of the torso portion.
Figure 4:
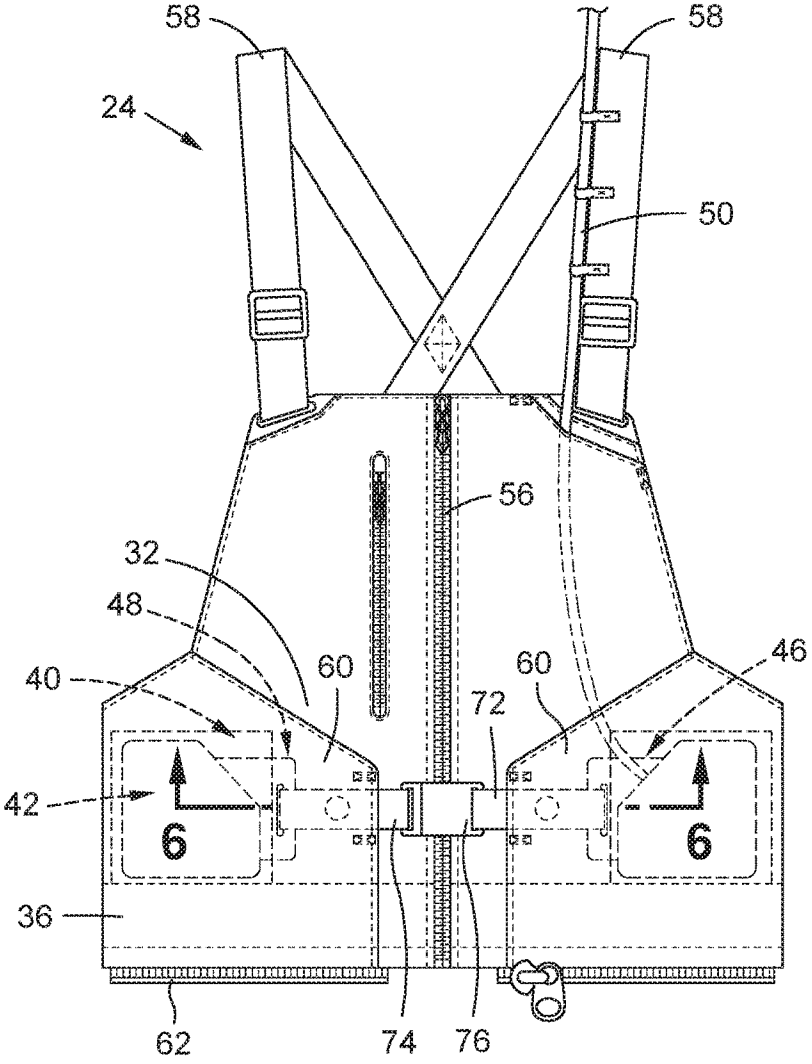
FIG. 4 is a front view of the torso portion.

Referring now to FIG. 1 there is depicted a perspective view of a user 10 (in dashed lining) wearing a bib 12 according to an embodiment of the invention. In accordance with one embodiment, there is provided the bib 12 for use by the user 10 worn about a user waist 14 and user torso 16 with an abdomen 18, a lower back 20 and shoulders 22. The bib 12 includes a torso portion 24 and a pants portion 26. FIG. 2 is a perspective view of the bib 12 with the torso portion 24 exploded from a pants portion 26. FIG. 3 is an enlarged perspective view of a portion of the torso portion 24 and the pants portion 26 where the two are removeably attached as viewed along axis 3-3 of FIG. 2. FIG. 4 is a front view of the torso portion 24. FIG. 5 is a back view of the torso portion 24.

The pants portion 26 includes a waist section 28 positionable about the user waist 14 when the bib 12 is worn by the user 10. The pants portion 26 further includes a pair of leg sections 30 that extend from the waist section 28. The torso portion 24 is attached to the pants portion 26 and extends from the waist section 28 away from the pair of leg sections 30. The torso portion 24 is positionable about the user torso 16 when the bib 12 is worn by the user 10. The torso portion 24 further includes a front panel 32 disposed adjacent the abdomen 18 of the user 10 when the bib 12 is worn by the user 10. The torso portion 24 further includes a back panel 34 disposed adjacent the lower back 20 of the user 10 when the bib 12 is worn by the user 10.

Figure 6:
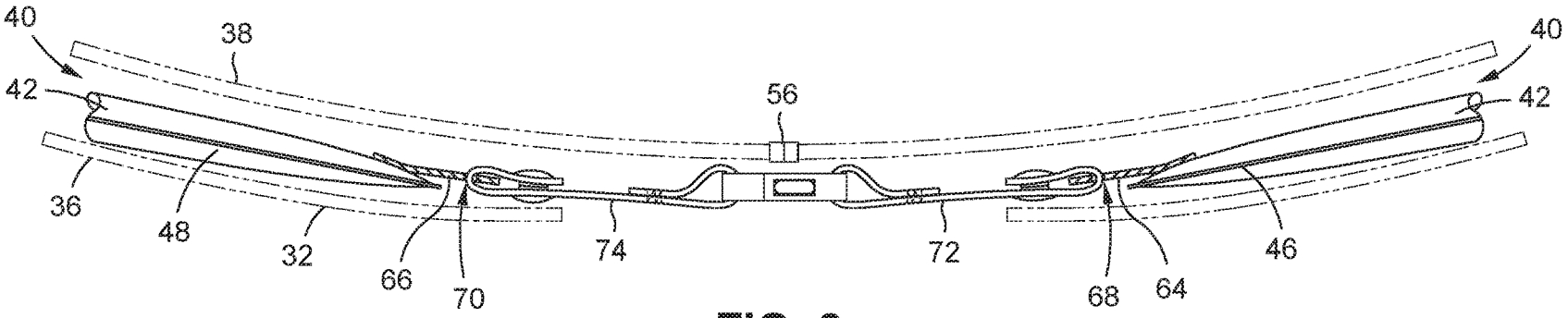
FIG. 6 is a top cross sectional view of a portion of the bib with a bladder fastener as viewed along axis 6-6 of FIG. 4.

Referring additionally to FIG. 6 there is a top cross sectional view of a portion of the bib 12 as viewed along axis 6-6 of FIG. 4. The torso portion 24 includes an outer surface 36 facing away from the user torso 16 when the bib 12 is worn by the user 10. The torso portion 24 includes an inner surface 38 facing towards the user torso 16 when the bib 12 is worn by the user 10. The bib 12 further includes a bladder pocket 40 that is disposed between the inner and outer surfaces 38, 36. The bladder pocket 40 extends from the front panel 32 around the back panel 34 and to the front panel 32. In this regard, the bladder pocket 40 wraps around the lower back 20 from each side of the abdomen 18 when the bib 12 is worn by the user 10. The bib 12 further includes an elongate liquid bladder 42 that is sized and configured to be inflated with a liquid. The liquid bladder 42 is disposed within the bladder pocket 40 and extends from the front panel 32 around the back panel 34 and to the front panel 32.

The present invention advantageously recognizes that the liquid bladder 42 may be integrated into the bib 12 and specifically positioned about the lower back 20 of the user 10 from each side of the abdomen 18 of the user 10 when the bib 12 is worn by the user 10. This allows for the user 10 to carry a personal water or liquid supply without the typical drawbacks of using a thermos or water bottle in a pocket or backpack and/or having to wear a backpack or hydration pack on one's upper and mid back. The shifting of mass commonly associated with traditional water or liquid transport configurations (such as backpack type arrangements) is mitigated by having the liquid bladder wrapped around the lower back 20 of the user 10 in a horizontal configuration. This is because such positioning is contemplated to be much closer to the center of gravity of the user 10. Also, this wrapped-around, horizontal configuration allows liquid bladder 42 to be snuggly fit about the user 10 adjacent the user waist 14.

According to various embodiments, the liquid bladder 42 may include a bladder body section 44 disposed between opposing bladder ends 46, 48. The liquid bladder 42 is configured to hold a liquid, such as water. The liquid bladder 42 may have an outlet port configured to allow water or other liquids to flow into and from within the liquid bladder 42. The bib 12 may further include a liquid conduit 50 in fluid communication with the liquid bladder 42 with the liquid conduit 50 extending from the liquid bladder 42 along front panel 32 away from the pants portion 26. The liquid conduit 50 may be configured to be within, in front of and/or behind the front panel 32. The liquid conduit 50 may include a nozzle that may be conveniently positioned adjacent the neck or upper chest of the user 10. The nozzle may be constructed with a bite valve to facilitate an ease of use by the user 10. This is particularly useful where the user 10 is able to access water or liquid within the liquid bladder 42 without the need to take off any gloves or mittens of the user 10, such when engaged in snow sports.

The inner surface 38 of the back panel 34 includes an inner access opening 52 that extends to the bladder pocket 40. In this regard, the liquid bladder 42 may be inserted into and removed from the bladder pocket 40 through the inner access opening 52. The bib 12 may further include an access fastening element 54 disposed about the inner access opening 52 for opening and closing the inner access opening 52. The access fastening element 54 may take the form of a zipper, such as depicted or other fastening means. It is contemplated that the inner access opening 52 may be of other sizes, such as beginning and ending along both sides of the front panel 42 (instead of the shortened embodiment just extending along the back panel 34).

The front panel 32 may include a front fastener 56, such as in the form of a zipper as depicted. This allows for ease of the user 10 putting on the bib 12 and for ease of access to the inner access opening 52. In an embodiment, front panel 32 of the torso portion 24 may extend beyond the abdomen 18 and the lower back 20 from the user waist 14 when the bib 12 is worn by the user 10. The bib 12 may further include shoulder straps 58 extending from the front panel to the back panel. The torso portion may be a vest. The torso portion 24 may include front flaps 60. The front flaps 60 may overlay the front panel 32, and are configured to flap open with the front fastener 56 disposed between the front flaps 60. The front flaps 60 are positioned to cover the bladder ends 46, 48 while maintaining easy access to the bladder ends 46, 48.

The pants portion 26 and the torso portion 24 may be removeably connected. In this regard in the embodiment depicted, the bib 12 may include a pants portion fastening element 62 disposed between the pants portion 26 and the torso portion 24 for removeably connecting the pants portion 26 and the torso portion 24. The pants portion fastening element 62 may be a zipper. Other means for removeably connecting the pants portion 26 and the torso portion 24 may be utilized such as those selected from those well known to one of ordinary skill in the art, such as buttons, tabs with snap fasteners, or hook and loop fasteners.

Figure 7:
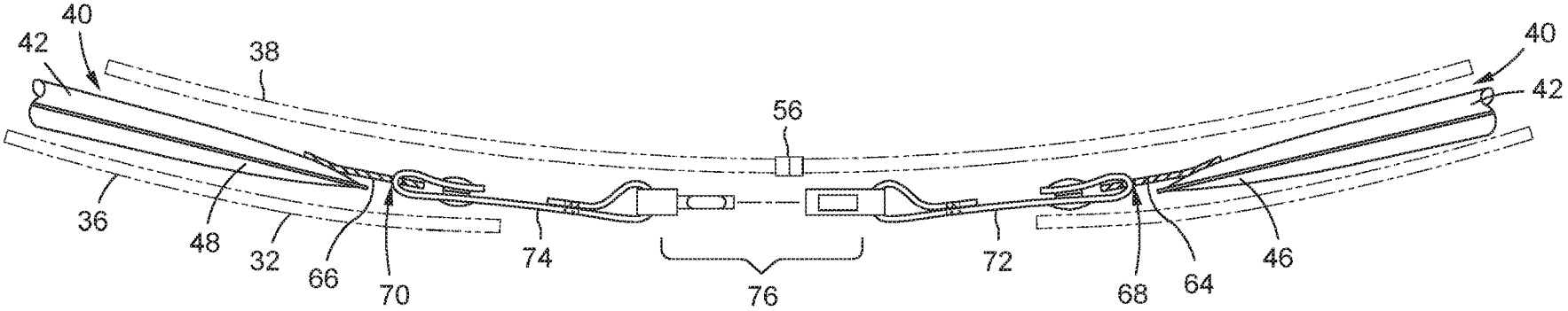
FIG. 7 is a top cross sectional view of a portion of the bib of FIG. 6 with the bladder fastener in an unfastened configuration.

The bladder ends 46, 48 may respectively include end tabs 64, 66. The end tabs 64, 66 respectively include slit 68, 70. A pair of fastener extensions 72, 74 may be provided with a bladder fastener 76 disposed between and connected to the fastener extensions 72, 74. FIG. 6 depicted the bladder fastener 76 in a fastened configuration. Referring additionally now to FIG. 7, there is depicted a top cross sectional view of a portion of the bib 12 of FIG. 6 with the bladder fastener 76 in an unfastened configuration. The fastener extensions 72, 74 are respectively threaded through each slit 68, 70. In this regard, the bladder fastener 76 is attached to the bladder ends 46, 48 for removably joining the bladder ends 46, 48. This allows the liquid bladder 42 to be completely and securely wrapped around the abdomen 18 and the lower back 20 of the user 10. This is contemplated to mitigate against unwanted shifting of weight associated with the carried liquid because the liquid bladder is securely wrapped completely around the user 10 and the load of liquid contained in the liquid bladder 42 is distributed about the user 10. This is in contrast to other hydration systems, such as a backpack where the load is concentrated at a user's upper back.

The fastener extensions 72, 74 may be formed of an elastic material, such as an elastic fabric that is configured to stretch longitudinally to provide adaptable tension. This allows for reduced motion constriction for the user 10 compared to a similar system without such added elasticity. When the user 10 bends this effectively increases the circumference of the user torso 16 about the abdomen 18. With the fastener extensions 72, 74 formed of an elastic material, the circumference of the liquid bladder 42 with the bladder fastener 76 fastened is able to expand and contract to accommodate various positions of user 10. All the while, the liquid bladder 42 is snuggly and comfortably fastened about the user 10. Additionally, with the fastener extensions 72, 74 formed of an elastic material, this provides the benefit of keeping the liquid bladder 42 snuggly about the user torso 16, even when liquid volume within the liquid bladder 42 decreases. As water of other liquid is consumed the volume of the liquid bladder 42 decreases and the circumference of the portion of the liquid bladder 42 facing the user torso 16 can increase. When this circumference increases, the liquid bladder 42 has the potential to not sit as snuggly against the body as when the liquid bladder 42 was full. The elastic nature of the fastener extensions 72, 74 allows naturally for a reduction of the circumference of the portion of the liquid bladder 42 facing the user torso 16. This is because when water or liquid is consumed, the weight of the liquid bladder 42 also decreases causing the tension on the bladder fastener 76 to decrease. This process results in a natural shortening of the fastener extensions 72, 74 which allow for consistent fit and snugness across various fill levels of the liquid bladder 42.

Figure 8:
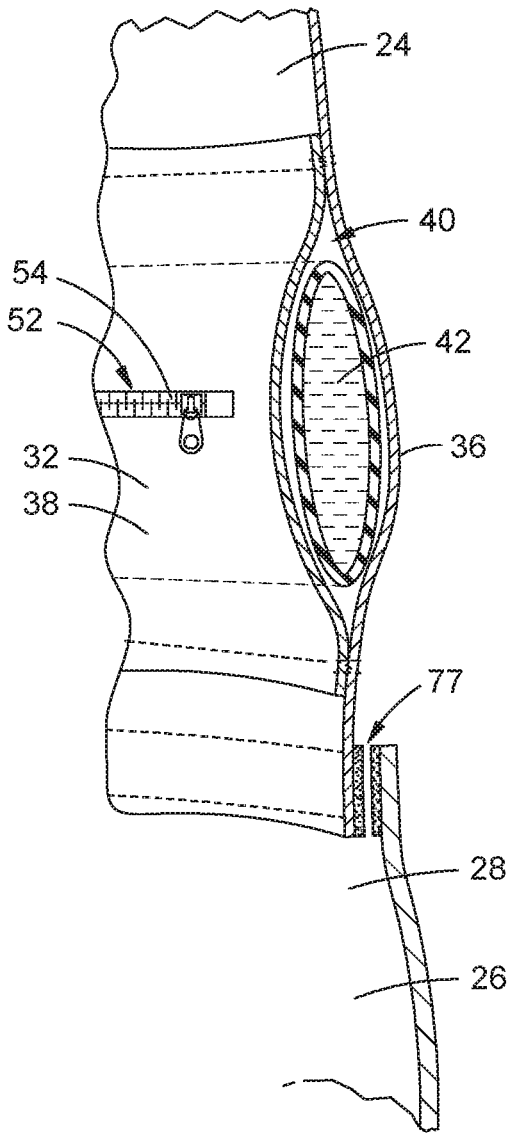
FIG. 8 is a top cross sectional view of a portion of the bib similar to FIG. 3, however with the torso portion and the pants portion removeably attached with hook and loop fasteners according to another embodiment.

Referring now to FIG. 8 is a top cross sectional view of a portion of the bib 12 similar to FIG. 3, however according to another embodiment with differences in the bib 12 as noted. Like reference numerals are intended to indicate like elements as described above. The torso portion 24 and the pants portion 26 are removeably attached with a pants portion fastening element 77 in the form of hook and loop fasteners.

Figure 9:
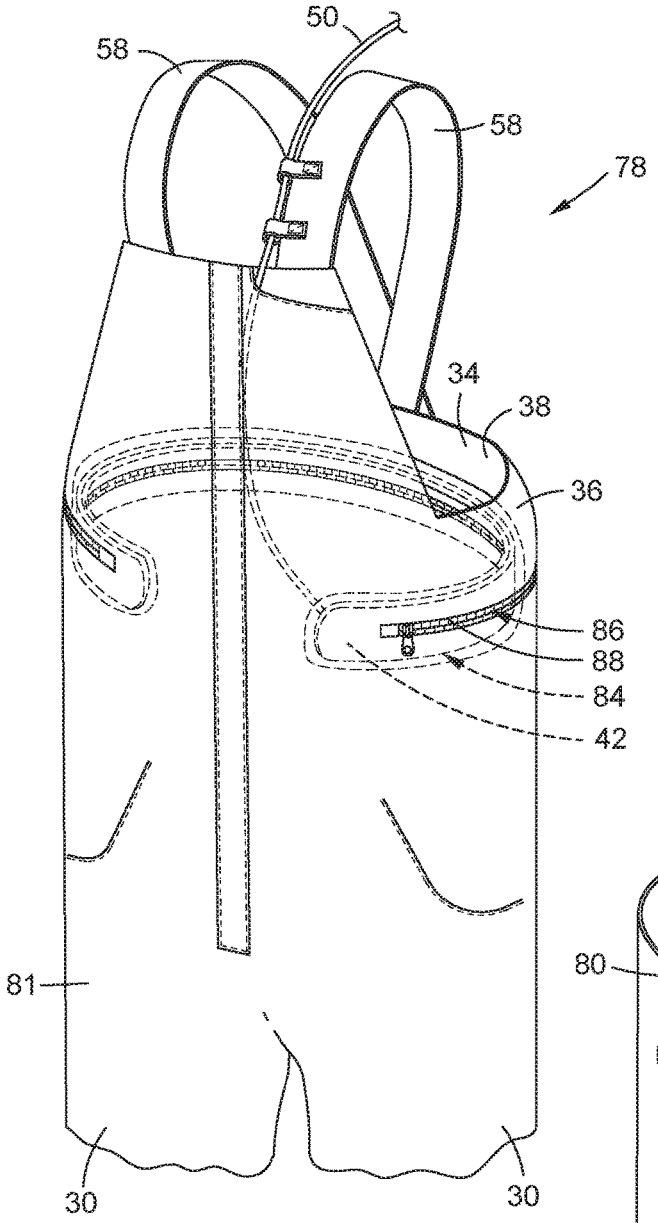
FIG. 9 is a front perspective view of a bib according to another embodiment with a torso portion integrated with a pants portion.
Figure 10:
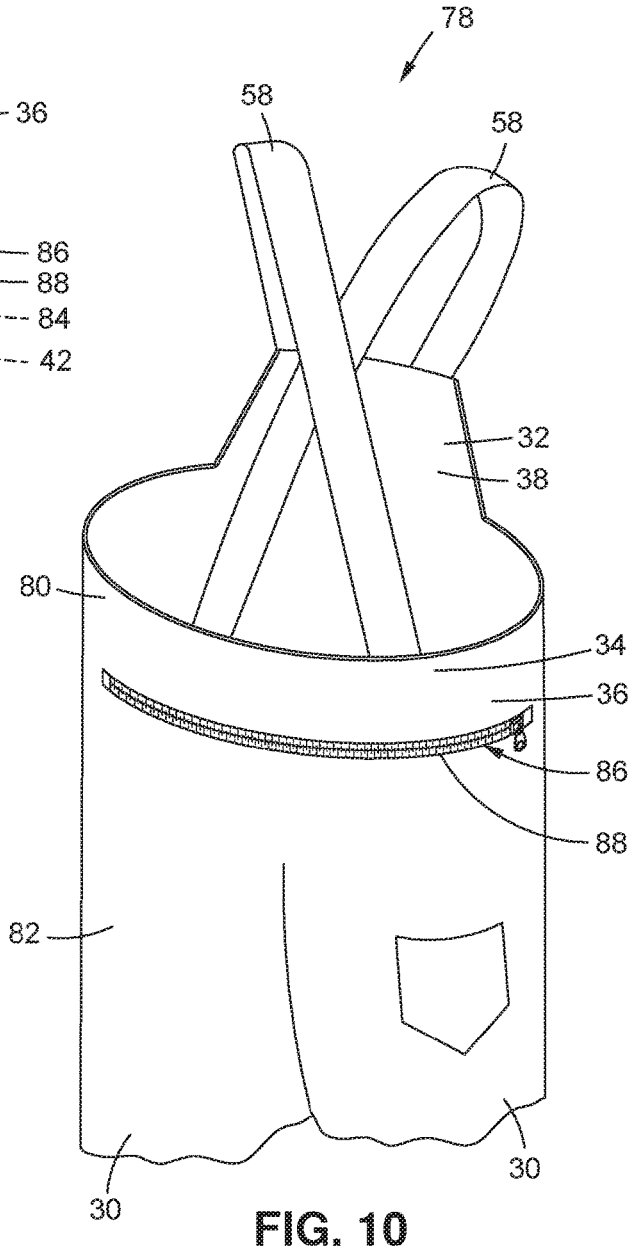
FIG. 10 is a back perspective view of the bib of FIG. 9.

Referring now to FIG. 9 is a front perspective view of a bib 78 according to another embodiment. FIG. 10 is a back perspective view of the bib 78 of FIG. 9. The bib 78 is similar to bib 12, however with the difference noted. Like reference numerals are intended to indicate like elements as described above. The bib 78 includes a torso portion 80 and a pants portion 82. In this embodiment the torso portion 80 is integrated with the pants portion 82 in a single unitary garment. This is unlike the bib 12, wherein the torso portion 24 is removably connected to the pants portion 26.

The bib 78 includes a bladder pocket 84. Further in this embodiment the outer surface 36 of the back panel 34 includes an outer access opening 86 that extends to the bladder pocket 84. In this regard, the liquid bladder 42 may be inserted into a removed from the bladder pocket 84 through the outside of the bib 78 via the outer access opening 86. The bib 78 may further include an access fastening element 88 disposed about the outer access 86 opening for opening and closing the outer access opening 86. The access fastening element 88 may take the form of a zipper as depicted.

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A bib for use by a user worn about a user waist and user torso with an abdomen and a lower back, the bib comprising:

a pants portion including a waist section positionable about the user waist when the bib is worn by the user and a pair of leg sections extending from the waist section;

a torso portion attached to the pants portion and extending from the waist section away from the pair of leg sections, the torso portion being positionable about the user torso when the bib is worn by the user, the torso portion including a front panel disposed adjacent the abdomen when the bib is worn by the user, the torso portion including a back panel disposed adjacent the lower back when the bib is worn by the user, the torso portion including an outer surface facing away from the user torso when the bib is worn by the user, the torso portion including an inner surface facing towards the user torso when the bib is worn by the user;

a bladder pocket disposed between the inner and outer surfaces extending from the front panel around the back panel and to the front panel; and an elongate liquid bladder being sized and configured to be inflated with a liquid, the liquid bladder disposed within the bladder pocket and extending from the front panel around the back panel and to the front panel.

2. The bib of claim 1 wherein the pants portion and the torso portion are not removeably connected.

3. The bib of claim 1 wherein the pants portion and the torso portion are removeably connected.

4. The bib of claim 3 further includes a pants portion fastening element disposed between the pants portion and the torso portion for removeably connecting the pants portion and the torso portion.

5. The bib of claim 1 wherein the pants portion fastening element is a zipper.

6. The bib of claim 1 wherein the torso portion extends beyond the abdomen and the lower back from the user waist when the bib is worn by the user.

7. The bib of claim 1 further includes shoulder straps extending from the front panel to the back panel.

8. The bib of claim 1 wherein the torso portion is a vest.

9. The bib of claim 1 wherein the outer surface of the back panel includes an outer access opening that extends to the bladder pocket.

10. The bib of claim 9 further includes an access fastening element disposed about the outer access opening for opening and closing the outer access opening.

11. The bib of claim 1 wherein the inner surface of the back panel includes an inner access opening that extends to the bladder pocket.

12. The bib of claim 11 further includes an access fastening element disposed about the inner access opening for opening and closing the inner access opening.

13. The bib of claim 1 wherein the liquid bladder includes a bladder body section disposed between opposing bladder ends.

14. The bib of claim 13 includes a bladder fastener attached to the bladder ends for removably joining the bladder ends.

15. The bib of claim 14 wherein the bladder ends are elastically connected to each other via the bladder fastener to allow the bladder ends to move relative to each other while being connected by the bladder fastener.

16. The bib of claim 14 further includes a pair of bladder extensions each disposed between a respective one of the bladder ends and the bladder fastener, the bladder extensions are formed of an elastomeric material.

* * * * *